United States Patent [19]

Rappleyea

[11] 4,335,472

[45] Jun. 22, 1982

[54] RETAINING ASSEMBLY FOR PROTECTIVE HEADGEAR

[75] Inventor: Frederick A. Rappleyea, Park Ridge, Ill.

[73] Assignee: The Kendall Company, Boston, Mass.

[21] Appl. No.: 156,247

[22] Filed: Jun. 4, 1980

[51] Int. Cl.[3] ..... A63B 71/10

[52] U.S. Cl. ..... 2/421; 2/425

[58] Field of Search ..... 2/421, 422, 425, 185 R, 2/9, ; 24/324

[56] References Cited

U.S. PATENT DOCUMENTS

| | | | |
|---|---|---|---|
| 1,654,479 | 12/1927 | Fenton | 24/324 |
| 3,327,316 | 6/1967 | Pukish | 2/421 |
| 3,619,813 | 11/1971 | Marchello | 2/421 |
| 3,873,997 | 4/1975 | Gooding | 2/421 |
| 4,233,687 | 11/1980 | Lancellotti | 2/425 X |

*Primary Examiner*—Louis Rimrodt

*Attorney, Agent, or Firm*—Powell L. Sprunger

[57] ABSTRACT

A retaining assembly for protective headgear comprising, a chin cup for receiving the wearer's chin, and a strap having one end for attachment to the headgear. The other end of the strap is releasably attached to a side of the chin cup such that the strap releases from the chin cup under loads.

6 Claims, 5 Drawing Figures

RETAINING ASSEMBLY FOR PROTECTIVE HEADGEAR

BACKGROUND OF THE INVENTION

The present invention relates to protective headgear, and more particularly to retaining assemblies for the headgear.

Before the present invention, an assortment of headgear has been proposed to protect the wearer's head from blows. The headgear may comprise a shell for covering the wearer's head and a retaining assembly for holding the shell on the wearer's head. The retaining assembly may have a chin cup to receive the wearer's chin and one or more straps extending from the chip cup to the shell. Since the retaining assembly retains the shell by the wearer's chin, an upper blow against the shell is transmitted by the chin cup to the wearer's jaw and ultimately to the wearer's neck, thus posing a risk of harm to the neck. Also, the straps of prior retaining assemblies are rigidly attached to the chin cup, and thus do not permit movement of the straps relative to the chin cup resulting in possibly a poor and uncomfortable fit on the wearer.

SUMMARY OF THE INVENTION

A principal feature of the present invention is the provision of an improved retaining assembly for protective headgear.

The retaining assembly of the present invention comprises, a chin cup for receiving the wearer's chin, and a strap having one end for attachment to the headgear. The assembly has means for releasably attaching the other end of the strap to a side of the chin cup.

A feature of the present invention is that the strap releases from the chin cup when the retaining assembly is placed under loads.

Thus, a feature of the present invention is that the retaining assembly permits release of the protective headgear from the head responsive to a hard upper blow to the headgear.

Another feature of the invention is that the retaining assembly thus minimizes the possibility of harm to the wearer's head and neck responsive to the blow.

Still another feature of the invention is that the strap is movably connected to the side of the chin strap.

Thus, another feature of the invention is that the retaining assembly provides adjustment and better conformability of the straps and chin cup to the particular wearer's head.

Further features will become more fully apparent in the following description of the embodiments of this invention and from the appended claims.

DESCRIPTION OF THE PREFERRED EMBODIMENTS

Figures 1, 2, 3, 4, 5:
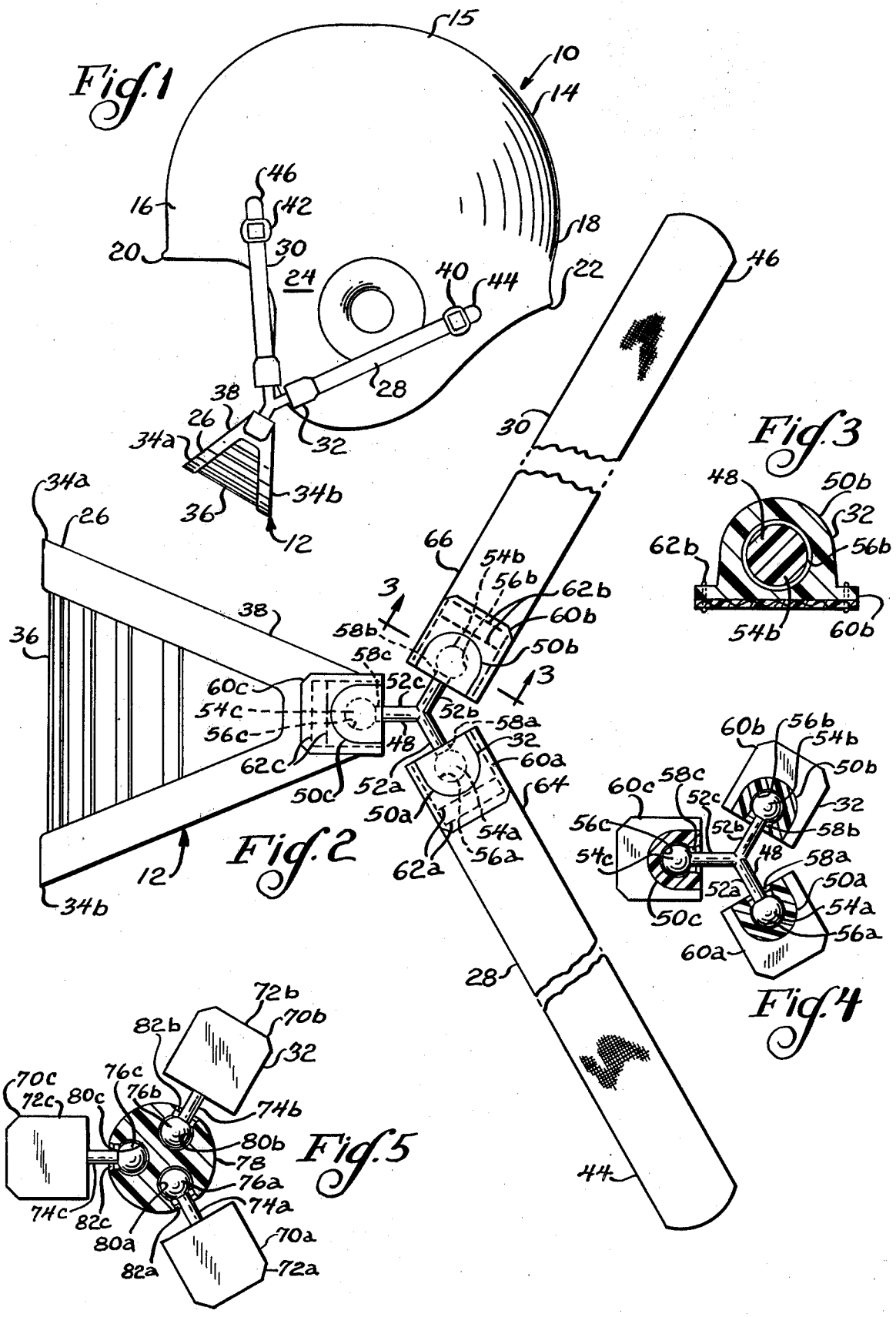
FIG. 1 is a side elevational view of a retaining assembly of the present invention for protective headgear.
FIG. 2 is an enlarged fragmentary side elevational view of the retaining assembly of FIG. 1.
FIG. 3 is a sectional view taken substantially as indicated along the line 3—3 of FIG. 2.
FIG. 4 is a sectional view showing a connecting assembly of the retaining assembly.
FIG. 5 is a sectional view showing another embodiment of a connecting assembly for the retaining assembly.

Referring now to FIG. 1 there is shown a protective helmet or headgear generally designated 10 and a retaining assembly 12 for the headgear 10. Although the helmet 10 is shown in the form of a football helmet, it will be understood that the principles of the invention may be utilized in connection with any other suitable headgear, such as hockey helmets, baseball helmets, crash helmets, or other headgear where protection of the head is desired. As shown, the helmet 10 has an outer shell 14 which is peferably made of a relatively rigid material, such as polycarbonate alloy, a rigid thermoplastic, or a thermosetting resin. The shell 14 has an upper central portion 15, a front portion 16, a rear portion 18, a lower front edge 20, a lower rear edge 22, and a pair of ear protectors 24.

The retaining assembly 12 has a chin cup 26 of conventional type, first and second chin straps 28 and 30 for attachment to the helmet 10, and a connecting assembly 32 for attachment of the chin cup 26 to the first and second straps 28 and 30. Of course, it will be understood that the retaining assembly 12 has a pair of straps and a connecting assembly of the same type on the other side of the chin cup for attachment of the chin cup to the other side of the helmet 10. The chin cup 26 has a pair of opposed edges 34*a* and 34*b*, an enlarged central portion 36 to receive the wearer's chin, and a side 38 for attachment to the connecting assembly 32. The first and second straps 28 and 30 have buckles 40 and 42 on associated first ends 44 and 46 of the straps 28 and 30 for attachment to connecting posts on a side of the helmet 10 adjacent the ear protector 24.

With reference to FIGS. 2–4, the connecting assembly 32 has a connecting member 48 and a plurality of housings 50*a*, 50*b*, and 50*c* respectively attached to the other ends 64 and 66 of the straps 28 and 30, respectively, and to the side 38 of the chin cup 26. The connecting member 48 and housings 50*a, b*, and *c* may be made of any suitable slightly flexible and resilient material, such as Surlyn, Nylon, or Delrin, trademarks of E. I. duPont de Nemours. The connecting member 48 has three necks 52*a*, 52*b*, and 52*c* which are connected together at one end in the central part of the connecting member 48 and which are disposed at 120° relative to each other in the connecting member 48. As shown, the connecting member 48 has a spherical enlargement 54*a*, 54*b*, and 54*c* at the outer end of each of the necks 52*a, b*, and *c*, respectively.

The housings 50*a, b*, and *c* have respective spherical cavities 56*a*, 56*b*, and 56*c* slightly larger than the enlargements 54*a, b*, and *c* to receive the enlargements 54*a, b*, and *c* with the necks 52*a, b*, and *c* being received in outer openings 58*a*, 58*b*, and 58*c* in the respective housings 50*a*, 50*b*, and 50*c*, with the openings 58*a, b*, and *c* communicating with the associated cavities 56*a, b*, and *c*. The openings 58*a, b*, and *c* are slightly smaller than the associated enlargements 54*a, b*, and *c*, such that the connecting member 48 is normally retained to the housings 50*a, b*, and *c*. However, the openings 58*a, b*, and *c* are sufficiently large to permit passage of the associated enlargement 54*a, b*, or *c* when the housings 50*a, b*, or *c* are placed under loads relative to the connecting member 48. Also, the housings 50*a, b*, and *c* permit pivotal movement of the connecting member 48 in the housing cavities 56*a, b*, and *c*. The housings 50*a, b*, and *c* have lower relatively thin outwardly extending tabs 60*a*, 60*b*, and 60*c*, respectively, which may be sewn to the associated straps 28 and 30 and chin cup 26 by lines of stitching 62*a*, 62*b*, and 62*c*, or the tabs 60*a, b*, and *c* may be attached by other suitable means, such as by heat sealing.

In use, the buckles 40 and 42 are adjusted on the first ends 44 and 46 of the straps 28 and 30, respectively, and the buckles 40 and 42 are attached to connecting posts on the shell 14 with the wearer's chin being received in the chin cup 26. Since the connecting member 48 is pivotally received in the housings 50*a, b*, and *c*, the connecting assembly 32 permits relative movement of the straps 28 and 30 and the chin cup 26 to permit conformability of the retaining assembly 12 to the shape of the wearer's head, thus providing comfort and an improved fit for the wearer. The enlargements 54*a, b*, and *c* are normally retained in the associated housings 50*a, b*, and *c*, such that the connecting assembly 32 normally retains the straps 28 and 30 to the chin cup 26. Thus, the retaining assembly 12 normally retains the shell 14 on the wearer's head while the chin is received in the chin cup 26. However, when a severe blow is applied upwardly or rearwardly to the shell 14, the force of the blow is transmitted to the retaining assembly 12. When the loads in the connecting assembly 32 are sufficiently large, one or more of the enlargements 54*a, b*, or *c* pass through the associated openings 58*a, b*, or *c* in order to open the connecting assembly 32 and release the retaining assembly 12 from the shell. Thus, in this manner, the retaining assembly 12 releases the shell 14 from the wearer's chin in order to prevent the blow from being transmitted to the wearer's jaw and neck, thus minimizing the possibility of harm to the wearer responsive to the severe blow.

Another embodiment of the connecting assembly 32 for the retaining assembly 12 is illustrated in FIG. 5. The connecting assembly 32 has three connecting members 70*a*, 70*b*, and 70*c* having inner tabs 72*a*, 72*b*, and 72*c* for respective attachment by suitable means, such as lines of stitching, to the straps 28 and 30 and the chin cup 26. The connecting members 70*a, b*, and *c* have outwardly directed necks 74*a*, 74*b*, and 74*c* with a spherical enlargement 76*a*, 76*b*, and 76*c* at the outer end of the respective necks 74*a, b*, and *c*.

The connecting assembly 32 has a cylindrical housing 78 with three spherical cavities 80*a*, 80*b*, and 80*c* disposed at 120° around the housing 78, with the cavities 80*a, b*, and *c* being slightly larger than the enlargements 76*a, b*, and *c*. The housing 78 has openings 82*a*, 82*b*, and 82*c* communicating with the respective cavities 80*a, b*, and *c*, such that the enlargements 76*a, b*, and *c* are received in the cavities 80*a, b*, and *c* with the adjacent portion of the necks 74*a, b*, and *c* being located in the respective openings 82*a, b*, and *c*. The openings 82*a, b*, and *c* are slightly smaller than the enlargements 76*a, b*, and *c* in order to normally retain the enlargements 76*a, b*, and *c* in the associated cavities 80*a, b*, and *c*, with pivotal movement of the connecting members 70*a, b*, and *c* being permitted in the associated cavities 80*a, b*, and *c*, and openings 82*a, b*, and *c*. However, the openings 82*a, b*, and *c* are sufficiently large to permit passage of the associated enlargements 76*a, b*, and *c* through the associated openings 82*a, b*, and *c* when large loads are applied to the connecting members 70*a, b*, and *c*.

Thus, the connecting assembly 32 of FIG. 5 operates in a manner similar to the connecting assembly 32 of FIGS. 1–4. The housing 78 permits pivotal movement of the connecting members 70*a, b*, and *c* in the housing 78 to permit relative movement of the straps and chip cup. Also, the connecting members 70*a, b*, and *c* are normally retained in the housing 78 in order to retain the straps to the chin cup. However, when a sufficiently large load is applied to the straps and chin cup, one or more of the connecting members 70*a, b*, or *c* release from the housing 78 responsive to the load in order to permit release of the retaining assembly 12 from the shell 14, thus minimizing the possibility of harm to the wearer's head and neck responsive to a severe blow to the shell.

The foregoing detailed description is given for clearness of understanding only, and no unnecessary limitations should be understood therefrom, as modifications will be obvious to those skilled in the art.

I claim:

1. A retaining assembly for protective headgear, comprising:

a chin cup for receiving the wearer's chin;

first and second straps having one end for attachment to the headgear;

a connecting member having three outwardly directed necks with an enlargement on the outer end of each neck; and a housing on a side of said chin cup and on the other ends of said first and second straps, each of said housings having a cavity to receive one of said enlargements and an opening communicating with the associated cavity to receive one of said necks, with said openings being slightly smaller than the associated enlargement and sufficiently large to permit release of the associated enlargement under loads.

2. The assembly of claim 1 wherein said necks are disposed at approximately 120 degrees in the connecting member relative to each other.

3. The assembly of claim 1 wherein each of said housings include a tab for attachment to the associated cup and first and second straps.

4. A retaining assembly for protective headgear comprising:

a chin cup for receiving the wearer's chin;

first and second straps having one end for attachment to the headgear;

a connecting member attached to a side of said cup and the other ends of said first and second straps, each of said connecting members having an outwardly directed neck and an outer enlargement; and a housing having three cavities to receive one of said enlargements and an opening communicating with each cavity to receive the associated neck, with said openings being slightly smaller than the associated enlargement and sufficiently large to permit release of the associated enlargement under loads.

5. The assembly of claim 4 wherein the openings of said housing are disposed at approximately 120 degrees around the housing.

6. The assembly of claim 4 wherein each of the connecting members includes an inner tab for attachment to the associated cup and first and second straps.

* * * * *